US012313057B2

(12) United States Patent
Clark et al.

(10) Patent No.: US 12,313,057 B2
(45) Date of Patent: May 27, 2025

(54) OPTIMIZING AN EFFICIENCY OF A POSITIVE DISPLACEMENT PUMP WITH A CONSTANT OR NEAR-CONSTANT SPEED POWER SOURCE

(71) Applicant: SPM Oil & Gas Inc., Fort Worth, TX (US)

(72) Inventors: Wesley P. Clark, Weatherford, TX (US); Todd Ryan Kabrich, Tomball, TX (US); Brandon J. Mabe, Houston, TX (US)

(73) Assignee: SPM Oil & Gas Inc., Fort Worth, TX (US)

( * ) Notice: Subject to any disclaimer, the term of this patent is extended or adjusted under 35 U.S.C. 154(b) by 323 days.

(21) Appl. No.: 17/650,780

(22) Filed: Feb. 11, 2022

(65) Prior Publication Data

US 2023/0258172 A1 Aug. 17, 2023

(51) Int. Cl.

| | |
|---|---|
| ***F04B 49/20*** | (2006.01) |
| ***E21B 43/26*** | (2006.01) |
| ***F04B 9/02*** | (2006.01) |
| ***F04B 17/03*** | (2006.01) |
| ***F04B 17/05*** | (2006.01) |

(52) U.S. Cl.

CPC ..... *F04B 49/20* (2013.01); *E21B 43/2607* (2020.05); *F04B 9/02* (2013.01); *F04B 17/03* (2013.01); *F04B 17/05* (2013.01); *F04B 2201/1201* (2013.01); *F04B 2205/09* (2013.01)

(58) Field of Classification Search

CPC .. F04B 49/20; F04B 9/02; F04B 17/03; F04B 17/05; F04B 2201/1201; F04B 2205/09; E21B 43/2607

See application file for complete search history.

(56) References Cited

U.S. PATENT DOCUMENTS

| | | | | |
|---|---|---|---|---|
| 4,899,857 | A * | 2/1990 | Tateno | B60W 10/18 477/901 |
| 5,848,877 | A * | 12/1998 | Dill | F04B 49/065 417/15 |
| 6,364,781 | B2 * | 4/2002 | Kundermann | F16D 13/71 464/185 |
| 7,901,314 | B2 | 3/2011 | Salvaire et al. | |
| 8,801,394 | B2 * | 8/2014 | Anderson | F04B 49/065 417/316 |

(Continued)

FOREIGN PATENT DOCUMENTS

| | | | |
|---|---|---|---|
| WO | 2021030048 | A1 | 2/2021 |
| WO | WO-2023082249 | A1 * | 5/2023 |

*Primary Examiner* — Charles G Freay

(57) ABSTRACT

In some implementations, a powertrain for powering a fluid pump may include a power source configured to rotate a first drive shaft at an approximately constant speed. The powertrain may include a mechanical transmission. The mechanical transmission may include one or more gearboxes associated with a set of fixed gear ratios, a second drive shaft coupled to the first drive shaft, and a third drive shaft coupled to an input drive shaft of the fluid pump and configured to rotate the input drive shaft at variable speeds or with variable torque based on using different gear ratios from the set of fixed gear ratios. The powertrain may include a torque converter disposed between the first drive shaft and the second drive shaft to enable the first drive shaft to be coupled to the second drive shaft.

20 Claims, 3 Drawing Sheets

(56) References Cited

U.S. PATENT DOCUMENTS

| | | | | |
|---|---|---|---|---|
| 11,028,842 | B2 | 6/2021 | Zhang et al. | |
| 11,125,066 | B1 | 9/2021 | Yeung et al. | |
| 2002/0183163 | A1* | 12/2002 | Etchason | F02D 41/022 477/110 |
| 2009/0291794 | A1* | 11/2009 | Amanuma | F16D 41/088 474/171 |
| 2015/0204322 | A1* | 7/2015 | Iund | E21B 7/00 175/48 |
| 2020/0340344 | A1 | 10/2020 | Reckels et al. | |
| 2021/0040830 | A1 | 2/2021 | Mu et al. | |
| 2022/0018234 | A1* | 1/2022 | Reddy | F04B 23/04 |

* cited by examiner

OPTIMIZING AN EFFICIENCY OF A POSITIVE DISPLACEMENT PUMP WITH A CONSTANT OR NEAR-CONSTANT SPEED POWER SOURCE

TECHNICAL FIELD

The present disclosure relates generally to hydraulic fracturing systems and, for example, to optimizing an efficiency of a positive displacement pump with a constant or near-constant speed power source.

BACKGROUND

Hydraulic fracturing is a well stimulation technique that typically involves pumping hydraulic fracturing fluid into a wellbore (e.g., using one or more well stimulation pumps) at a rate and a pressure (e.g., up to 15,000 pounds per square inch) sufficient to form fractures in a rock formation surrounding the wellbore. This well stimulation technique often enhances the natural fracturing of a rock formation to increase the permeability of the rock formation, thereby improving recovery of water, oil, natural gas, and/or other fluids.

A hydraulic fracturing system may include one or more power sources for providing power to components (e.g., the pumps) of the hydraulic fracturing system. In some cases, the power source for a pump of the hydraulic fracturing system may be variable speed power source that is capable of varying an output speed (e.g., varying a revolutions per minute (RPM) associated with the power source) to adjust the power and speed of the pump. However, variable speed power sources may be associated with reduced efficiency when operating at non-optimized speeds. In order to improve the efficiency of the hydraulic fracturing system and/or the pumps, a constant, or near-constant, power source may be used to power a pump of the hydraulic fracturing system. The constant, or near-constant, power source may operate at, or near, an optimized speed (e.g., without variability in the speed output by the power source) to increase an efficiency associated with the power source. However, constant, or near-constant, power sources may be associated with a lack of variability of a speed provided to a pump. As a result, the pump, powered by the constant, or near-constant, power source, may be capable of only operating at a given flow rate or within a small range of flow rates.

The powertrain of the present disclosure solves one or more of the problems set forth above and/or other problems in the art.

SUMMARY

In some implementations, a system for hydraulic fracturing includes a positive displacement pump; a constant speed power source configured to drive the positive displacement pump, wherein the constant speed power source is configured to rotate a power source drive shaft at an approximately constant speed; a powertrain, configured to deliver power from the constant speed power source to the positive displacement pump, including a multi-gear transmission configured to operate using a set of fixed gear ratios; and a controller configured to: obtain a flow rate value to be associated with the positive displacement pump; determine a fixed gear ratio, from the set of fixed gear ratios, that is optimized to cause an input drive shaft of the positive displacement pump to power the positive displacement pump at approximately the flow rate value based on the approximately constant speed of the power source drive shaft; and cause the multi-gear transmission to operate using the fixed gear ratio to cause the positive displacement pump to operate at approximately the flow rate value.

In some implementations, a powertrain for powering a fluid pump includes a power source configured to rotate a first drive shaft at an approximately constant speed; a mechanical transmission including: one or more gearboxes associated with a set of fixed gear ratios, a second drive shaft coupled to the first drive shaft, and a third drive shaft coupled to an input drive shaft of the fluid pump and configured to rotate the input drive shaft at variable speeds or with variable torque based on using different gear ratios from the set of fixed gear ratios; and a torque converter disposed between the first drive shaft and the second drive shaft to enable the first drive shaft to be coupled to the second drive shaft.

In some implementations, a method includes obtaining a flow rate value for a positive displacement pump, wherein the positive displacement pump is powered via a constant speed power source; determining a gear ratio, from a set of gear ratios associated with a multi-gear transmission coupled to the constant speed power source and the positive displacement pump, based on a speed at which the constant speed power source operates and the flow rate value; causing the multi-gear transmission to operate using the gear ratio; and causing, based on causing the multi-gear transmission to operate using the gear ratio, the positive displacement pump to operate at approximately the flow rate value.

DETAILED DESCRIPTION

Figure 1:
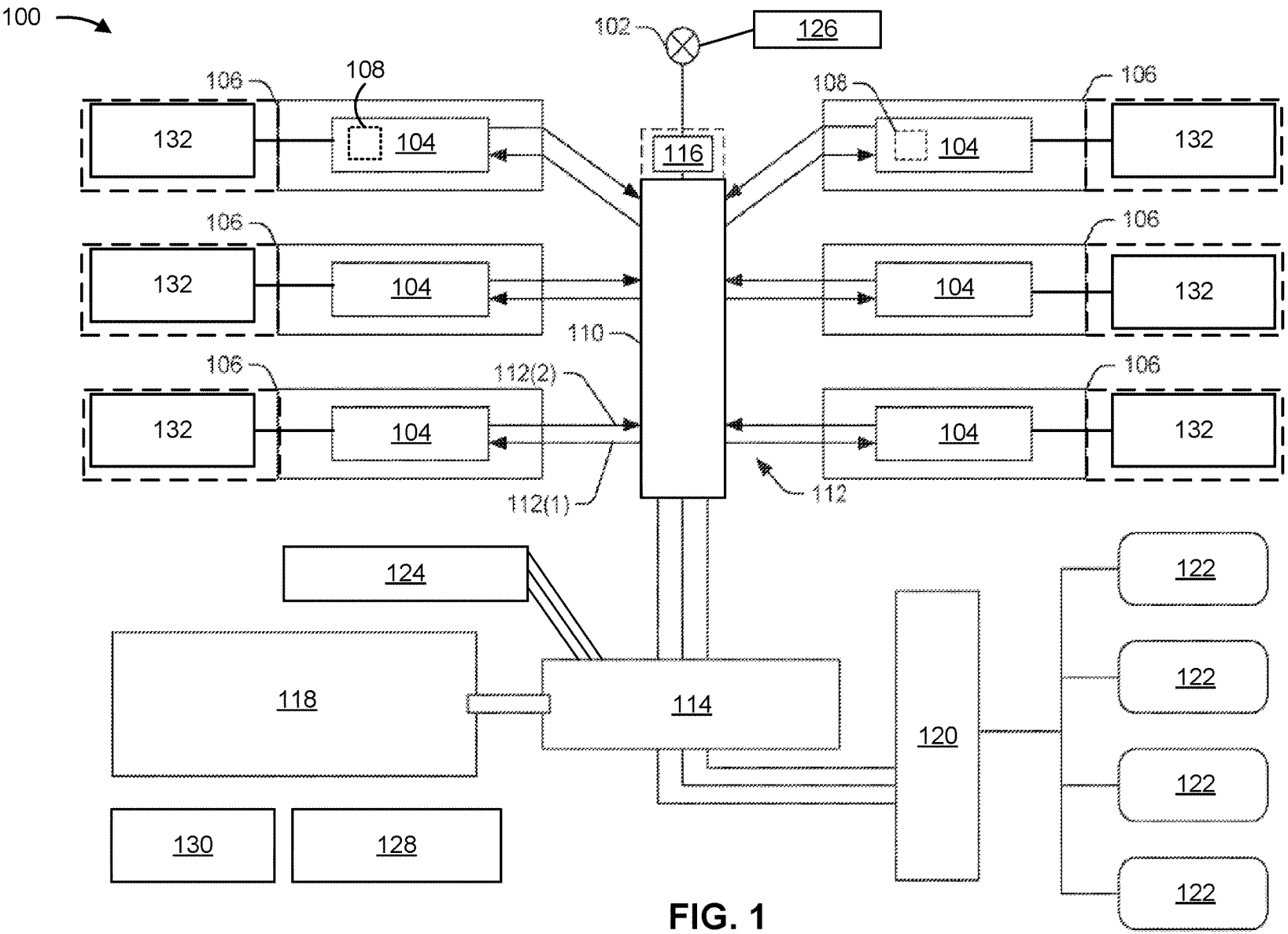
FIG. 1 is a diagram of an example hydraulic fracturing system described herein.

FIG. 1 is a diagram illustrating an example hydraulic fracturing system 100 described herein. For example, FIG. 1 depicts a plan view of an example hydraulic fracturing site along with equipment that is used during a hydraulic fracturing process. In some examples, less equipment, additional equipment, or alternative equipment to the example equipment depicted in FIG. 1 may be used to conduct the hydraulic fracturing process.

The hydraulic fracturing system 100 includes a well 102. As described previously, hydraulic fracturing is a well-stimulation technique that uses high-pressure injection of fracturing fluid into the well 102 and corresponding wellbore in order to hydraulically fracture a rock formation surrounding the wellbore. While the description provided herein describes hydraulic fracturing in the context of wellbore stimulation for oil and gas production, the description herein is also applicable to other uses of hydraulic fracturing.

High-pressure injection of the fracturing fluid may be achieved by one or more pump systems 104 that may be mounted (or housed) on one or more hydraulic fracturing trailers 106 (which also may be referred to as "hydraulic fracturing rigs") of the hydraulic fracturing system 100. Each of the pump systems 104 includes at least one fluid pump 108 (referred to herein collectively, as "fluid pumps 108" and individually as "a fluid pump 108"). The fluid pumps 108 may be hydraulic fracturing pumps. The fluid pumps 108 may be positive displacement pumps. The fluid pumps 108 may include various types of high-volume hydraulic fracturing pumps such as triplex or quintuplex pumps. Additionally, or alternatively, the fluid pumps 108 may include other types of reciprocating positive-displacement pumps or gear pumps. A type and/or a configuration of the fluid pumps 108 may vary depending on the fracture gradient of the rock formation that will be hydraulically fractured, the quantity of fluid pumps 108 used in the hydraulic fracturing system 100, the flow rate necessary to complete the hydraulic fracture, and/or the pressure necessary to complete the hydraulic fracture, among other examples. The hydraulic fracturing system 100 may include any number of trailers 106 having fluid pumps 108 thereon in order to pump hydraulic fracturing fluid at a predetermined rate and pressure.

In some examples, the fluid pumps 108 may be in fluid communication with a manifold 110 via various fluid conduits 112, such as flow lines, pipes, or other types of fluid conduits. The manifold 110 combines fracturing fluid received from the fluid pumps 108 prior to injecting the fracturing fluid into the well 102. The manifold 110 also distributes fracturing fluid to the fluid pumps 108 that the manifold 110 receives from a blender 114 of the hydraulic fracturing system 100. In some examples, the various fluids are transferred between the various components of the hydraulic fracturing system 100 via the fluid conduits 112. The fluid conduits 112 include low-pressure fluid conduits 112(1) and high-pressure fluid conduits 112(2). In some examples, the low-pressure fluid conduits 112(1) deliver fracturing fluid from the manifold 110 to the fluid pumps 108, and the high-pressure fluid conduits 112(2) transfer high-pressure fracturing fluid from the fluid pumps 108 to the manifold 110.

The manifold 110 also includes a fracturing head 116. The fracturing head 116 may be included on a same support structure as the manifold 110. The fracturing head 116 receives fracturing fluid from the manifold 110 and delivers the fracturing fluid to the well 102 (via a well head mounted on the well 102) during a hydraulic fracturing process. In some examples, the fracturing head 116 may be fluidly connected to multiple wells 102. The fluid pumps 108, the fluid conduits 112, the manifold 110, and/or the fracturing head 116 may define a fluid system of the hydraulic fracturing system 100.

The blender 114 combines proppant received from a proppant storage unit 118 with fluid received from a hydration unit 120 of the hydraulic fracturing system 100. In some examples, the proppant storage unit 118 may include a dump truck, a truck with a trailer, one or more silos, or other type of containers. The hydration unit 120 receives water from one or more water tanks 122. In some examples, the hydraulic fracturing system 100 may receive water from water pits, water trucks, water lines, and/or any other suitable source of water. The hydration unit 120 may include one or more tanks, pumps, gates, or the like.

The hydration unit 120 may add fluid additives, such as polymers or other chemical additives, to the water. Such additives may increase the viscosity of the fracturing fluid prior to mixing the fluid with proppant in the blender 114. The additives may also modify a pH of the fracturing fluid to an appropriate level for injection into a targeted formation surrounding the wellbore. Additionally, or alternatively, the hydraulic fracturing system 100 may include one or more fluid additive storage units 124 that store fluid additives. The fluid additive storage unit 124 may be in fluid communication with the hydration unit 120 and/or the blender 114 to add fluid additives to the fracturing fluid.

In some examples, the hydraulic fracturing system 100 may include a balancing pump 126. The balancing pump 126 provides balancing of a differential pressure in an annulus of the well 102. The hydraulic fracturing system 100 may include a data monitoring system 128. The data monitoring system 128 may manage and/or monitor the hydraulic fracturing process performed by the hydraulic fracturing system 100 and the equipment used in the process. In some examples, the management and/or monitoring operations may be performed from multiple locations. The data monitoring system 128 may be supported on a van, a truck, or may be otherwise mobile. The data monitoring system 128 may include a display for displaying data for monitoring performance and/or optimizing operation of the hydraulic fracturing system 100. In some examples, the data gathered by the data monitoring system 128 may be sent off-board or off-site for monitoring performance and/or performing calculations relative to the hydraulic fracturing system 100.

The hydraulic fracturing system 100 includes a controller 130. The controller 130 is in communication (e.g., by a wired connection or a wireless connection) with the pump systems 104 of the trailers 106. The controller 130 may also be in communication with other equipment and/or systems of the hydraulic fracturing system 100. The controller 130 may include one or more memories, one or more processors, and/or one or more communication components. The controller 130 (e.g., the one or more processors) may be configured to perform operations associated with optimizing an efficiency of the fluid pumps 108, as described in connection with FIGS. 2 and 3.

The hydraulic fracturing system 100 may include one or more power sources 132. The one or more power sources 132 may be included on a hydraulic fracturing trailers 106 (e.g., as shown by the dashed lines in FIG. 1). Alternatively, a power source 132 may be separate from the hydraulic fracturing trailers 106. In some examples, each pump system 104 may include a power source 132. The power sources 132 may be in communication with the controller 130. The power sources 132 may power the pump systems 104 and/or the fluid pumps 108. A power source 132 described herein may be a constant speed power source or a near constant speed power source. As used herein, "constant speed" or "near constant speed" may refer to a power source that is configured to produce an output speed that remains approximately constant (e.g., remains within a threshold range of a target speed and/or a target power) when the power source 132 is in operation. For example, the target speed and/or the target power may be associated with an optimized efficiency (e.g., fuel efficiency or another efficiency) of an operation of the power source 132. In other words, a constant speed power source or a near constant speed power source may provide a non-variable output speed (e.g., may rotate an output drive shaft at a speed that is not variable). As used herein an "approximately constant speed" may refer to a speed with is within a threshold range of the speed. The power source 132 may be mechanically coupled to a fluid pump 108 to provide power to the fluid pump 108. As described in more detail elsewhere herein, the power source 132 may be mechanically coupled to the fluid pump 108 via a powertrain that includes a multi-gear transmission (e.g., a gear train and/or one or more gearboxes).

As indicated above, FIG. 1 is provided as an example. Other examples may differ from what is described with regard to FIG. 1.

Figure 2:
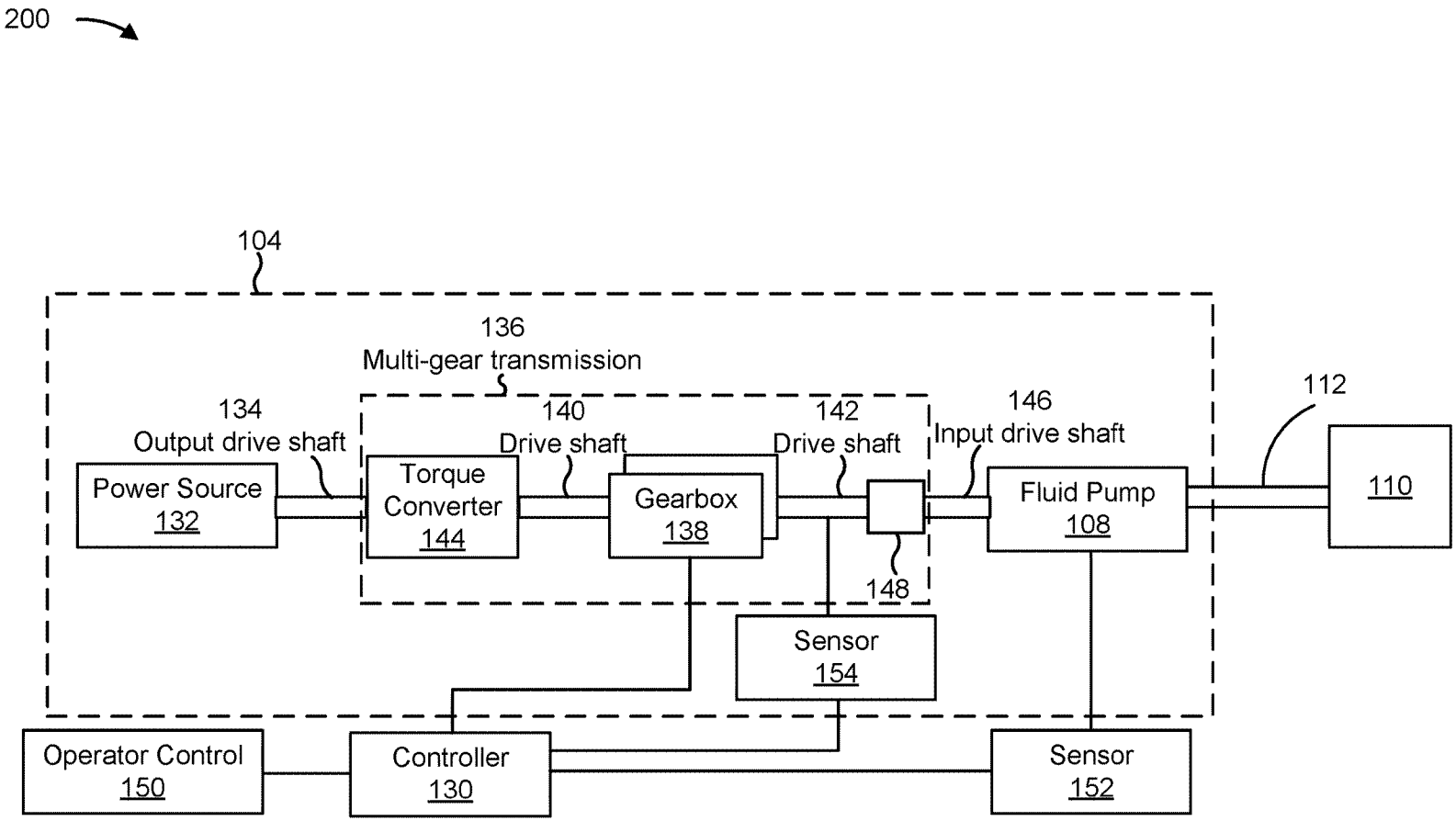
FIG. 2 is a diagram of an example powertrain described herein.

FIG. 2 is a diagram of an example powertrain 200 described herein. The powertrain 200 may include one or more components of the hydraulic fracturing system 100, as described herein.

As shown in FIG. 2, the powertrain 200 may include at least one fluid conduit 112 and/or the manifold 110, as described herein. The fluid conduit(s) 112 may be in fluid communication with the fluid pump 108. For example, the fluid conduit(s) 112 may fluidly connect the fluid pump 108 and the manifold 110, the manifold 110 and the well 102 (e.g., via the fracturing head 116), or the like. In other words, the fluid conduit(s) 112 may fluidly connect components of the hydraulic fracturing system 100 that are downstream of the fluid pump 108.

The powertrain 200 may include a power source 132. The power source 132 may power or drive the fluid pump 108, as described herein. For example, the powertrain 200 may be configured to deliver power from a constant speed power source (e.g., the power source 132) to a positive displacement pump (e.g., the fluid pump 108). As described above, the power source 132 may be a constant speed power source or a near constant speed power source. For example, the power source 132 may be a turbine (e.g., a gas turbine), a motor (e.g., an electric motor) that is configured to operate at a constant speed or a near constant speed, or an engine (e.g., a reciprocating engine) that is configured to operate at a constant speed or a near constant speed, among other examples. For example, the power source 132 may be configured to cause an output drive shaft 134, of the power source 132, to rotate at an approximately constant speed (e.g., an approximately constant speed that is configured to optimize a performance or efficiency of the power source 132). The output drive shaft 134 may also be referred to as a power source drive shaft herein.

The powertrain 200 may include a multi-gear transmission 136 coupled to the power source 132 (e.g., via a shaft coupling, a driveline coupling, and/or a torque converter, as described below). The multi-gear transmission 136 may be configured to change (e.g., increase or decrease) a speed (e.g., an RPM value) and/or a torque that is output by the power source 132 (e.g., via the output drive shaft 134). For example, the multi-gear transmission 136 may be configured to operate using a set of fixed gear ratios. The multi-gear transmission 136 may include one or more gearboxes 138. The gearbox(es) 138 may include a set of gears configured to achieve the set of fixed gear ratios. For example, the output drive shaft 134 may be coupled (e.g., connected) to a drive shaft 140 that serves as an input to the one or more gearboxes 138. The gearbox(es) 138 may be operative to change (e.g., increase or decrease) a speed (e.g., an RPM value) and/or a torque that associated with the drive shaft 140 via a configuration of the internal gears of the gearbox(es) 138. For example, a speed (e.g., a rotational speed or RPM value) and/or torque of a drive shaft 142 (e.g., that serves as an output of the one or more gearboxes 138 and/or the multi-gear transmission 136) may be determined based on a configured gear ratio of the one or more gearboxes 138 (e.g., from the set of fixed gear ratios associated with the multi-gear transmission 136).

A gearbox 138 may include a set of gears that can be configured to produce different gear ratios. A gearbox 138 may be a sliding mesh gearbox, a constant mesh gearbox, a synchromesh gearbox, an epicyclic gearbox, a hydraulic torque converter, and/or a planetary gearbox, among other examples. A gearbox 138 may be configured to operate using different gear ratios by modifying which gears are meshed and/or coupled to drive shafts of the gearbox 138. As a result, based on the configured gear ratio, a speed and/or torque of the drive shaft 142 may be different than the speed and/or torque of the drive shaft 140.

The multi-gear transmission 136 may be a manual transmission. For example, the multi-gear transmission 136 may be operated via manual input from a user. A user may engage a component (e.g., a clutch), such as a component 148 described in more detail elsewhere herein, that enables engagement and disengagement of a coupling of a drive shaft of the multi-gear transmission 136 to another drive shaft (e.g., the output drive shaft 134 or an input drive shaft 146 of the fluid pump 108) to enable a gear ratio of the multi-gear transmission 136 to be changed. For example, the multi-gear transmission 136 may include synchronizer component (e.g., a synchro) and/or a gear-selector fork that is coupled to a shifter that is operated by the user. The user may operate the shifter to cause the selector fork and the synchro to engage gears that produce a gear ratio associated with an input selected by the user. For example, the manual transmission may be a sliding-gear transmission (e.g., where a main drive gear is moved or slide along a main shaft drive above a cluster gear to produce a desired gear ratio), or a constant mesh transmission (e.g., where a drive gear, a cluster gear, and one or more main shaft gears are in constant motion and a dog clutch is used to lock the drive gear, the cluster gear, and the main shaft gear(s) in place to produce a desired gear ratio), among other examples.

In some other examples, the multi-gear transmission 136 may be an automatic transmission. In such examples, the controller 130 may be configured to transmit instructions to the gearbox 138 to cause the gearbox 138 to shift to an indicated gear ratio. For example, the multi-gear transmission 136 may include a clutch and/or gear configuration (e.g., similar to a manual transmission and/or other gearbox configurations described above) and one or more sensors, actuators, processors, and/or pneumatic components, among other examples, to identify shift points (e.g., a time at which a gear ratio of the multi-gear transmission 136 is to change) and to automatically change a gear ratio of multi-gear transmission 136 (e.g., based on inputs received from the controller 130).

In some implementations, the multi-gear transmission 136 may include multiple gearboxes, or multiple transmissions, coupled to one another (e.g., via shaft couplings or driveline couplings). For example, the multi-gear transmission 136 may include a first multi-gear transmission (e.g., a first gearbox) mechanically coupled with a second multi-gear transmission (e.g., a second gearbox). The first multi-gear transmission may be associated with a first quantity of gear ratios, and the second multi-gear transmission may be associated with a second quantity of gear ratios. By mechanically coupling the multiple transmissions or the multiple gearboxes in line, a compounding effect of the gear ratios may be realized, thereby increasing the quantity of gear ratios in which the multi-gear transmission 136 can operate. This may provide additional options for a speed at which the input drive shaft 146 can be powered (e.g., which the output drive shaft 134 remains at the approximately constant speed), thereby providing increased flexibility for flow rates that can be produced by the fluid pump 108.

The powertrain 200 and/or the multi-gear transmission 136 may include a torque converter 144. The torque converter 144 may be disposed between a first drive shaft of the power source 132 (e.g., the output drive shaft 134) and a second drive shaft of the multi-gear transmission 136 (e.g., the drive shaft 140) to enable the first drive shaft to be coupled to the second drive shaft. For example, the torque converter 144 may enable the fluid pump 108 to transition from an inactive state or a static state (e.g., where the drive shafts of the multi-gear transmission 136 and/or the input drive shaft 146 are idling or not rotating) to an active state or a rotating state (e.g., where the drive shafts of the multi-gear transmission 136 and/or the input drive shaft 146 are rotating at an operational speed) while the output drive shaft 134 rotates at the approximately constant speed. For example, the torque converter 144 may include a fluid coupling joint that transfers rotating power from the power source 132 to the drive shaft 140 of the multi-gear transmission 136. The torque converter 144 may include an impeller (e.g., that is mechanically driven by the power source 132 and the output drive shaft 134), a turbine (e.g., that drives the drive shaft 140), and a stator that is interposed between the impeller and turbine so that the stator can alter fluid flow returning from the turbine to the impeller. The stator is provided to redirect the returning fluid flow such that it aids the rotation of the impeller, instead of opposing it. This results in energy that is recovered from the returning fluid and added to the energy supplied by the power source 132 to the impeller. This also increases a fluid flow which is directed to the turbine, producing an increase in output torque. Alternatively, the multi-gear transmission 136 may include a mechanical component (e.g., a mechanical clutch) disposed in a similar location as the torque converter 144 to engage and disengage a coupling of the output drive shaft 134 to the drive shaft 140 to enable the multi-gear transmission 136 to change gears and/or to change rotational speeds which the output drive shaft 134 is rotating at the approximately constant speed.

As shown in FIG. 2, the fluid pump may be driven by the input drive shaft 146. For example, by causing the input drive shaft 146 to rotate at different speeds, different flow rates may be produced by the fluid pump 108. The input drive shaft 146 may be coupled to the drive shaft 142 of the multi-gear transmission 136 (e.g., the output drive shaft of the multi-gear transmission 136), such as via a shaft coupling or a driveline coupling. As described above, the multi-gear transmission 136 may be configured (e.g., via operating using different gear ratios) to cause the drive shaft 142 to rotate at different speeds and/or with different torques while the output drive shaft 134 of the power source 132 remains rotating at the approximately constant speed. As a result, by causing the multi-gear transmission 136 to operate using a given gear ratio, a desired rotation speed of the input drive shaft (e.g., that is operative to cause a desired flow rate of the fluid pump 108) may be achieved while using the constant, or near constant, speed power source to power the fluid pump 108.

The input drive shaft 146 may be coupled to the drive shaft 142 via a component 148 configured to engage or disengage the input drive shaft 146 from an output drive shaft (e.g., the drive shaft 142) of the multi-gear transmission 136. The component 148 may be a mechanical clutch or another component. The component 148 may be operated via a manual user input or based on instructions provided by the controller 130. The component 148 may disengage the coupling of the input drive shaft 146 to the drive shaft 142 to enable the multi-gear transmission 136 to change a gear ratio at which the multi-gear transmission 136 is operating. The component 148 may engage the coupling of the input drive shaft 146 to the drive shaft 142 when the multi-gear transmission 136 is operating using the desired gear ratio. In some implementations, the component 148 may not be included in the powertrain 200 and/or the multi-gear transmission. In such examples, the input drive shaft 146 may be mechanically and/or permanently coupled to the drive shaft 142 without a configuration to enable the coupling to be engaged or disengaged.

The powertrain 200 and/or the multi-gear transmission 136 may include a variable speed component disposed at and/or coupled to the drive shaft 142. For example, the powertrain 200 and/or the multi-gear transmission 136 may include a variable speed transmission (e.g., a continuously variable transmission (CVT)) that is coupled to an output drive shaft (e.g., the drive shaft 142) of the multi-gear transmission 136 and the input drive shaft 146. The variable speed component may be configured to change seamlessly through a continuous range of gear ratios. For example, the multi-gear transmission 136 may be configured to cause the drive shaft 142 to rotate at finite increments of speeds (e.g., based on the configured gear ratio). For example, a first gear ratio may cause drive shaft 142 to rotate at a first speed, and a second gear ratio may cause the drive shaft 142 to rotate at a second speed. The variable speed component may enable the powertrain 200 to cause the input drive shaft 146 to rotate at speeds that are between the finite speeds capable of being produced by the multi-gear transmission 136. For example, a first gear ratio may cause drive shaft 142 to rotate at a first speed, and a second gear ratio may cause the drive shaft 142 to rotate at a second speed. The variable speed component may enable the powertrain 200 to cause the input drive shaft 146 to rotate at speeds that are between the first speed and the second speed (e.g., thereby providing increased flexibility and/or control of the speed of the input drive shaft 146 that is powered by the constant or near constant speed power source 132).

The controller 130 may obtain a flow rate value to be associated with the fluid pump 108. The flow rate value may be a flow rate value for a given fluid pump 108 or may be a flow rate value for the entire hydraulic fracturing system 100. For example, the controller 130 may determine setting and/or gear ratios for multiple fluid pumps 108 (for example, in a similar manner as described in more detail below) to achieve a desired flow rate value for the entire hydraulic fracturing system 100. For example, the controller 130 may obtain a setting for a flow rate associated with the fluid pump 108. For example, the setting for the flow rate may indicate a flow rate for the fluid pump 108 or a flow rate of the fluid system that includes the fluid pump 108 and at least one additional fluid pump (e.g., where fluid flows of the fluid pumps are combined at the manifold 110). The setting for the flow rate may indicate a commanded flow rate for the fluid pump 108. In some implementations, the controller 130 may obtain the setting for the flow rate from a local or a remote memory or other storage, from another device, or the like, in a similar manner as described above. Additionally, or alternatively, to obtain the setting for the flow rate, the controller 130 may receive an input (e.g., an operator input) that indicates the setting for the flow rate, in a similar manner as described above. The controller 130 obtaining the setting for the flow rate may trigger a ramp up of the fluid pump 108. In some implementations, the controller 130 may obtain the flow rate value from an operator control 150 (e.g., a human-machine interface). The operator control 150 may be located at the data monitoring system 128, elsewhere at a hydraulic fracturing site, or remote from the hydraulic fracturing site.

In some examples (e.g., based on obtaining the setting for the flow rate), the controller 130 may indicate, to a component of the multi-gear transmission or another component, a gear ratio, to be used by the multi-gear transmission, that is based on the setting for the flow rate. For example, the controller 130 may determine a fixed gear ratio, from the set of fixed gear ratios associated with the multi-gear transmission 136, that is optimized to cause the input drive shaft 146 of the fluid pump 108 to power the fluid pump 108 at approximately the flow rate value (e.g., based on the approximately constant speed of the output drive shaft 134). In other words, the controller 130 may determine a gear ratio that will produce a given speed (e.g., that is optimized to cause the input drive shaft 146 of the fluid pump 108 to power the fluid pump 108 at approximately the flow rate value) based on the approximately constant speed of the output drive shaft 134.

For example, as described elsewhere herein, the multi-gear transmission may be associated with a set of gear ratios that cause the drive shaft 142 to rotate at a set of speeds (e.g., based on the approximately constant speed of the output drive shaft 134). The controller 130 may determine a gear ratio, from the set of gear ratios, that corresponds to a speed that matches, or is closest to (e.g., among the set of speeds), a speed that will cause the fluid pump 108 to operate at the flow rate value. In some implementations, the controller 130 may determine the fixed gear ratio based on a user or operator input. For example, a user may manually operate the powertrain 200 to select the gear ratio (e.g., by manually shifting the multi-gear transmission 136 into the desired gear ratio). If the powertrain 200 includes a variable speed component, then the controller 130 may determine a setting for the variable speed component (e.g., based on the speed of the drive shaft 142 caused by the determined gear ratio) to cause the input drive shaft 146 to rotate at a speed that achieves the flow rate value.

The controller 130 may cause the multi-gear transmission 136 to operate using the determined fixed gear ratio to cause the fluid pump 108 to operate at approximately the flow rate value. For example, the controller 130 may transmit a command that causes the multi-gear transmission 136 to shift into the determined gear ratio. As a result, the drive shaft 142 and/or the input drive shaft 146 may rotate at a speed that powers the fluid pump 108 to operate at approximately the flow rate value. Alternatively, an operator may manually shift the multi-gear transmission 136 into the determined fixed gear ratio (e.g., via a manual shifter and/or other components) to cause the fluid pump 108 to operate at approximately the flow rate value.

The controller 130 may obtain a measurement relating to a flow rate associated with the fluid pump 108 (e.g., a flow rate of the fluid pump 108 or a flow rate of the fluid system that includes the fluid pump 108 and at least one additional fluid pump). For example, the controller 130 may obtain the measurement relating to the flow rate from a sensor 152 (e.g., a flow meter) configured to detect the flow rate associated with the fluid pump 108. The sensor 152 may be located at an outlet of the fluid pump 108, in the fluid conduit 112 in fluid communication with the outlet of the fluid pump 108, in the manifold 110, or the like.

The controller 130 may obtain a measurement relating to a speed of the drive shaft 142, the input drive shaft 146, and/or the output drive shaft 134. The controller 130 may obtain the measurement of the speed from one or more sensors 154 (e.g., a rotational speed sensor, such as a magneto-resistive sensor or another type of rotational speed sensor). The sensor(s) 154 may be located at the drive shaft 142, the input drive shaft 146, and/or the output drive shaft 134.

The controller 130 may monitor the flow rate associated with the fluid pump 108 and/or the speeds of the drive shaft 142, the input drive shaft 146, and/or the output drive shaft 134. The controller 130 may determine a gear ratio in which the multi-gear transmission is to operate based on the flow rate associated with the fluid pump 108 and the speed(s) of the drive shaft 142, the input drive shaft 146, and/or the output drive shaft 134. For example, the controller 130 may determine a speed at which the input drive shaft 146 is to rotate to achieve a desired flow rate of the fluid pump 108 based on a current flow rate of the fluid pump 108, a current speed of the output drive shaft 134 and/or a current speed with the input drive shaft 146. The controller 130 may determine a gear ratio that will cause the drive shaft 142 and/or the input drive shaft 146 to rotate at a speed to cause the fluid pump to transition for the current flow rate to the desired flow rate. In other words, the various gear ratios of the multi-gear transmission may provide flexibility and controllability of a speed of the input drive shaft 146 (e.g., and thereby a flow rate of the fluid pump 108) when the fluid pump is powered by a constant speed or near constant speed power source (e.g., the power source 132).

In some implementations, the one or more sensors 154 may include a torque sensor. The controller 130 may monitor torque measurements associated with the multi-gear transmission 136. The controller 130 may determine a gear ratio in which the multi-gear transmission is to operate based on the measured torque (for example, of one or more drive shafts of the multi-gear transmission 136). For example, the controller 130 may determine a gear ratio in which the multi-gear transmission is to operate to ensure that the torque experienced by the multi-gear transmission 136 satisfies a threshold. For example, the power source 132 may be capable of generating more torque on the multi-gear transmission 136 than can be safely experienced by the multi-gear transmission 136 (e.g., because of the constant speed output by the power source 132). Therefore, the torque sensor(s) may enable the system to monitor the torque experienced by the multi-gear transmission 136 to ensure the torque values stay within safe levels.

As indicated above, FIG. 2 is provided as an example. Other examples may differ from what is described with regard to FIG. 2.

Figure 3:
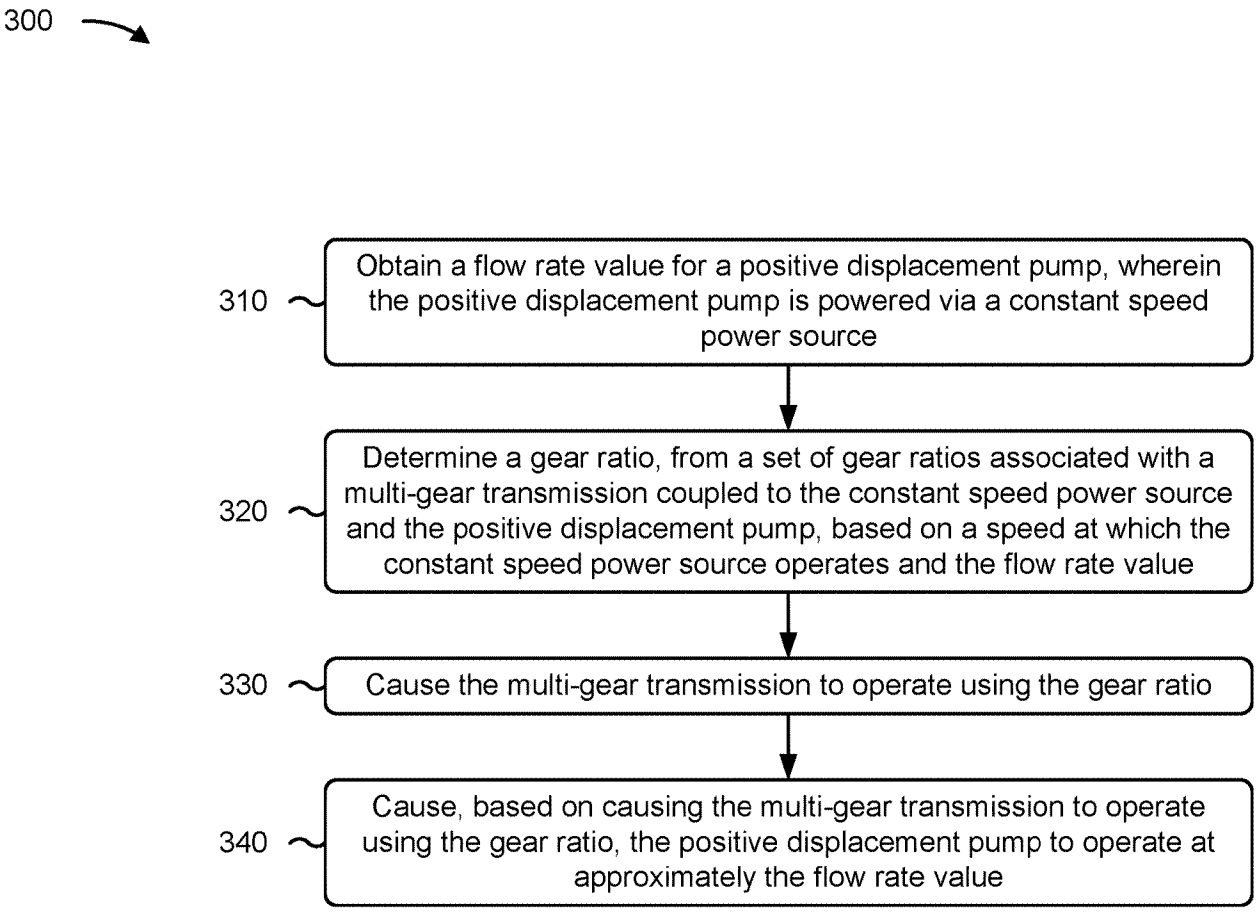
FIG. 3 is a flowchart of an example processes relating to optimizing an efficiency of a positive displacement pump with a constant or near-constant speed power source.

FIG. 3 is a flowchart of an example process 300 associated with optimizing an efficiency of a positive displacement pump with a constant or near-constant speed power source. In some implementations, one or more process blocks of FIG. 3 may be performed by a controller (e.g., controller 130). In some implementations, one or more process blocks of FIG. 3 may be performed by another device or a group of devices separate from or including the controller, such as another device or component that is internal or external to the hydraulic fracturing system 100 and/or the powertrain 200. Additionally, or alternatively, one or more process blocks of FIG. 3 may be performed by one or more components of a device, such as a processor, a memory, an input component, an output component, and/or communication component.

As shown in FIG. 3, process 300 may include obtaining a flow rate value for a positive displacement pump, wherein the positive displacement pump is powered via a constant speed power source (block 310). For example, the controller (e.g., using a processor, a memory, a communication component, or the like) may obtain a flow rate value for a positive displacement pump. The positive displacement pump may be powered via a constant speed power source, as described above. The positive displacement pump may be a hydraulic fracturing pump.

As further shown in FIG. 3, process 300 may include determining a gear ratio, from a set of gear ratios associated with a multi-gear transmission coupled to the constant speed power source and the positive displacement pump, based on a speed at which the constant speed power source operates and the flow rate value (block 320). For example, the controller (e.g., using a processor, a memory, a communication component, or the like) may determine a gear ratio, from a set of gear ratios associated with a multi-gear transmission coupled to the constant speed power source and the positive displacement pump, based on a speed at which the constant speed power source operates and the flow rate value, as described above. For example, the controller may receive a user input indicating the flow rate value.

As further shown in FIG. 3, process 300 may include causing the multi-gear transmission to operate using the gear ratio (block 330). For example, the controller (e.g., using a processor, a memory, a communication component, or the like) may cause the multi-gear transmission to operate using the gear ratio, as described above. For example, the controller may cause the multi-gear transmission to switch from another gear ratio, from the set of gear ratios, to the gear ratio, where the other gear ratio causes an output drive shaft of the multi-gear transmission to rotate at a first speed, where the gear ratio causes the output drive shaft to rotate at a second speed, and where the output drive shaft is coupled to an input drive shaft of the positive displacement pump.

As further shown in FIG. 3, process 300 may include causing, based on causing the multi-gear transmission to operate using the gear ratio, the positive displacement pump to operate at approximately the flow rate value (block 340). For example, the controller may cause, based on causing the multi-gear transmission to operate using the gear ratio, the positive displacement pump to operate at approximately the flow rate value, as described above. For example, the controller may cause an input drive shaft of the positive displacement pump to rotate at a first speed that is different than a second speed of an output drive shaft of the constant speed power source based on the multi-gear transmission operating using the gear ratio, wherein the first speed is associated with causing the positive displacement pump to operate at approximately the flow rate value.

The multi-gear transmission may include a variable speed transmission that is coupled to an output drive shaft of the multi-gear transmission and an input drive shaft of the positive displacement pump.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The powertrain described herein may be used with any hydraulic fracturing system that pressurizes hydraulic fracturing fluid using fluid pumps driven by constant speed, or near constant speed, power sources. For example, to improve the efficiency of the hydraulic fracturing system and/or the fluid pumps, a constant, or near-constant, power source may be used to power a fluid pump of the hydraulic fracturing system. The constant, or near-constant, power source may operate at, or near, an optimized speed (e.g., without variability in the speed output by the power source) to increase an efficiency associated with the power source. However, constant, or near-constant, power sources may be associated with a lack of variability of a speed provided to a fluid pump. As a result, the fluid pump, powered by the constant, or near-constant, power source, may be capable of only operating at a given flow rate or within a small range of flow rates.

The powertrain described herein is useful for providing variability, flexibility, and/or controllability to an input speed provided to a fluid pump that is powered by the constant, or near-constant, power source. For example, the powertrain may include one or more transmissions or gearboxes that are configured to operate using a set of gear ratios. Therefore, an output drive shaft may continually rotate at an approximately constant speed (e.g., to increase an efficiency of the power source) and the powertrain may provide variable input speeds to the fluid pump based on a gear ratio in which the powertrain (e.g., in which a transmission of the powertrain) is operating. As a result, a flow rate produced by the fluid pump may be varied (e.g., by varying the input speeds to the fluid pump provided by the powertrain) while also enabling the power source to operate at an optimized speed (e.g., the approximately constant speed). Accordingly, an efficiency of the pump system may be increased (e.g., by enabling the power source to operate at, or near, the optimized speed) without sacrificing variability, flexibility, and/or controllability of a flow rate produced by the fluid pump.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A system for hydraulic fracturing, comprising:

a positive displacement pump;

a constant speed power source configured to drive the positive displacement pump, wherein the constant speed power source is configured to rotate a power source drive shaft at an approximately constant speed;

a powertrain, configured to deliver power from the constant speed power source to the positive displacement pump, including:

a multi-gear transmission configured to operate using a set of fixed gear ratios and coupled to the constant speed power source via a shaft coupling;

a torque sensor configured to measure a torque associated with the multi-gear transmission; and a controller configured to:

obtain a flow rate value to be associated with the positive displacement pump;

determine a fixed gear ratio, from the set of fixed gear ratios, that is optimized to cause an input drive shaft of the positive displacement pump to power the positive displacement pump at approximately the flow rate value based on the approximately constant speed of the power source drive shaft and based on the torque associated with the multi-gear transmission satisfying a threshold; and cause the multi-gear transmission to operate using the determined fixed gear ratio to cause the positive displacement pump to operate at approximately the flow rate value.

2. The system of claim 1, wherein the powertrain includes a torque converter that is coupled to the power source drive shaft and a transmission drive shaft of the multi-gear transmission, wherein the torque converter enables the positive displacement pump to transition from an inactive state to an active state while the power source drive shaft rotates at the approximately constant speed.

3. The system of claim 1, further comprising:

a mechanical clutch configured to engage or disengage the input drive shaft of the positive displacement pump from an output drive shaft of the multi-gear transmission.

4. The system of claim 1, wherein the multi-gear transmission includes a first multi-gear transmission mechanically coupled with a second multi-gear transmission.

5. The system of claim 4, wherein the first multi-gear transmission is associated with a first quantity of gear ratios and the second multi-gear transmission is associated with a second quantity of gear ratios.

6. The system of claim 1, wherein the controller, to determine the fixed gear ratio, is configured to:

receive a user input indicating the determined fixed gear ratio.

7. The system of claim 1, wherein the constant speed power source includes at least one of:

a gas turbine, an electric motor, or a reciprocating engine.

8. A powertrain for powering a fluid pump, comprising:

a power source configured to rotate a first drive shaft at an approximately constant speed;

a mechanical transmission including:

one or more gearboxes associated with a set of fixed gear ratios, a second drive shaft coupled to the first drive shaft, and a third drive shaft coupled to an input drive shaft of the fluid pump and configured to rotate the input drive shaft of the fluid pump at variable speeds or with variable torque based on using different gear ratios from the set of fixed gear ratios, wherein the mechanical transmission is coupled to the power source via a coupling;

a torque converter disposed between the first drive shaft and the second drive shaft to enable the first drive shaft to be coupled to the second drive shaft; and a controller configured to determine a gear ratio, of the different gear ratios, in which the mechanical transmission is to operate, to cause the input drive shaft of the fluid pump to power the fluid pump at approximately a flow rate value that corresponds to a flow rate setting associated with the positive displacement pump and based on the approximately constant speed of the first drive shaft, and to ensure that a torque experienced by the mechanical transmission satisfies a threshold.

9. The powertrain of claim 8, wherein the controller is further configured to:

cause the mechanical transmission to operate using the determined gear ratio to cause the mechanical transmission to rotate the input drive shaft of the fluid pump.

10. The powertrain of claim 8, wherein the torque converter includes a fluid coupling joint to enable the second drive shaft to transition from a static state to a rotating state while the first drive shaft rotates at the approximately constant speed.

11. The powertrain of claim 8, further comprising:

a clutch is configured to enable engagement and disengagement of the input drive shaft and the third drive shaft.

12. The powertrain of claim 8, wherein the one or more gearboxes includes a first gearbox, associated with a first gear ratio, mechanically coupled to a second gearbox associated with a second gear ratio.

13. The powertrain of claim 8, wherein the power source includes at least one of:

a gas turbine, an electric motor, or a reciprocating engine.

14. The powertrain of claim 8, wherein the fluid pump is at least one of a positive displacement pump or a hydraulic fracturing pump.

15. A method, comprising:

obtaining, from a torque sensor, a torque measurement associated with a multi-gear transmission coupled, via a coupling, to a constant speed power source that powers a positive displacement pump;

determining a gear ratio, from a set of gear ratios associated with the multi-gear transmission in which the multi-gear transmission is to operate to ensure that the torque measurement associated with the multi-gear transmission satisfies a threshold;

causing the multi-gear transmission to operate using the determined gear ratio; and causing, based on causing the multi-gear transmission to operate using the determined gear ratio, the positive displacement pump to operate at approximately a flow rate value that corresponds to a flow rate setting associated with the positive displacement pump.

16. The method of claim 15, wherein causing the multi-gear transmission to operate using the determined gear ratio comprises:

causing the multi-gear transmission to switch from a different gear ratio, from the set of gear ratios, to the determined gear ratio, wherein the different gear ratio causes a drive shaft of the multi-gear transmission to rotate at a first speed, and wherein the determined gear ratio causes the drive shaft of the multi-gear transmission to rotate at a second speed.

17. The method of claim 15, further comprising:

receiving a user input indicating the flow rate setting.

18. The method of claim 15, wherein causing the positive displacement pump to operate at approximately the flow rate value comprises:

causing an input drive shaft of the positive displacement pump to rotate at a first speed that is different than a second speed of an output drive shaft of the constant speed power source based on the multi-gear transmission operating using the determined gear ratio, wherein the first speed is associated with causing the positive displacement pump to operate at approximately the flow rate value.

19. The method of claim 15, wherein the positive displacement pump is a hydraulic fracturing pump, and wherein the coupling is a shaft coupling.

20. The method of claim 15, wherein the multi-gear transmission includes a variable speed transmission that is coupled to an output drive shaft of the multi-gear transmission and an input drive shaft of the positive displacement pump.

* * * * *